US005980391A

United States Patent [19]

Lanzetta, Jr.

[11] Patent Number: 5,980,391

[45] Date of Patent: Nov. 9, 1999

[54] BALL LIFT ASSEMBLY FOR BALL RETURN SYSTEM OF A BOWLING ALLEY

[76] Inventor: Vincent F. Lanzetta, Jr., 5041 Lofton Dr., New Port Richey, Fla. 34652

[21] Appl. No.: 09/080,154

[22] Filed: May 18, 1998

[51] Int. Cl.[6] ..... A63D 5/02

[52] U.S. Cl. ..... 473/111

[58] Field of Search ..... 473/73, 99, 106, 473/110, 111

[56] References Cited

U.S. PATENT DOCUMENTS

| | | | |
|---|---|---|---|
| 751,170 | 2/1904 | Hopkins et al. . | |
| 809,245 | 1/1906 | Brinkmeyer . | |
| 2,242,069 | 5/1941 | Heiniger | 473/111 |
| 2,817,530 | 12/1957 | Black et al. . | |
| 3,184,239 | 5/1965 | Heuser . | |
| 3,185,475 | 5/1965 | Miller . | |
| 3,297,322 | 1/1967 | Ernst et al. | 473/99 |
| 3,300,212 | 1/1967 | Cornell . | |
| 4,071,240 | 1/1978 | Camilleri | 473/111 |
| 4,509,752 | 4/1985 | Schmidt | 273/49 |
| 5,076,582 | 12/1991 | Edwards | 273/37 |
| 5,630,761 | 5/1997 | Anderson et al. | 473/110 |
| 5,649,868 | 7/1997 | Gooss | 473/106 |

*Primary Examiner*—William M. Pierce
*Attorney, Agent, or Firm*—Harold D. Shall

[57] ABSTRACT

A portion of an AMF ball return system is disclosed wherein the ball lift belt is shown with two humps thereon, and when the belt is rotated, a bowling ball is compressed between a hump on the belt and the adjoining lift rail. A ball placed thereon rolls up the lift ramp and down the engaging hump while moving the ball.

4 Claims, 3 Drawing Sheets

BALL LIFT ASSEMBLY FOR BALL RETURN SYSTEM OF A BOWLING ALLEY

BACKGROUND OF THE INVENTION

1. Field of Invention

This invention relates to bowling ball return systems for bowling alleys, and particularly to an improved ball lift assembly for such a system and the ball lift belt thereof.

2. Description of Prior Art

This ball lift assembly is for use as a replacement for the original equipment ball lift assembly in AMF's (American Machine and Foundry's) ball return systems identified by AMF as their earlier KICKER ROLLER SYSTEM and their current P.B.L. (Positive Ball Lift System). Both these systems are currently in use.

In the Kicker Roller System, applicant's improved assembly replaces the ball return belt, and also the following items are eliminated: the ball door exit and the kicker roller assembly. In this system, kicker wheels spin around rubbing against the ball to force the ball up the track to the wedge position between a belt and the track. Once wedged, the belt's friction and movement carries the ball to the top of the lift. However, oil on the bowling lane is picked up by the ball as it rolls down the lane. Some of this oil gets deposited on the kicker wheels, creating slipping between the ball and the wheels, and the ball never reaches the wedge position resulting in a stuck ball. When this system was first introduced by AMF, it worked satisfactorily because there was much less oil used on the bowling lane. In recent years, with the much improved bowling balls, bowling lanes place much more oil on the lanes to control the ball's curving. This additional oil has created the problem that exists today, for this additional oil causes the additional deposits on the kicker wheels.

The newer system (P.B.L.) does not use kickers. This system allows the ball to free-fall into the ball exit opening and under the ball lift belt, onto a pressure plate referred to as the lift arm assembly. The ball pressure on the track rail assembly activates a ratchet assembly which raises the plate that the ball landed on. This raising pushes the ball up between the ball lift belt and the lift rail, creating the wedge of the ball between these items needed to lift the ball up the lift rail. The P.B.L. system pushes the ball up only a matter of inches, creating a weak partial wedge. Oil on the ball allows slippage and the ball falls back down, causing reactivation of the pressure plate to go up and come down again repeatedly, creating a yo-yo effect and a stuck ball.

SUMMARY OF THE INVENTION

The current invention includes an improved ball lift belt which is humorously referred to by the inventor as the "Hump Back Belt", which replaces the lift belt in the above referred to assemblies; the P.B.L. and the Kicker Roller design, and allows for the removal of all the mechanical mechanisms used to lift the ball to and against the belt.

The major difference between the belt of this invention and prior belts is the change in the ball engaging surface of the belt. At least one section of the belt's engaging surfaces is raised higher than the remainder of the engaging surface. Two or more spaced and raised surfaces can be used to provide quicker ball return; however, the number of such raised surfaces is limited by the speed interval desired by the returning balls so as not to cause damage to the ball return rack or the individual retrieving ball.

In the preferred embodiment, each "hump" is twenty-nine inches (29") long and one-half inch (½") high and thickness tapered at each end, and is permanently bonded to the belt (belts of the P.B.L. and KICKER SYSTEMS can be so modified). A neoprene rubber covering is then bonded around the entire surface of the belt, resulting in a belt having a new appearance with raised molded sections one-half inch (½") higher than the surface of the remainder of the belt.

DETAILED DESCRIPTION OF THE PREFERRED EMBODIMENT

Figure 1:
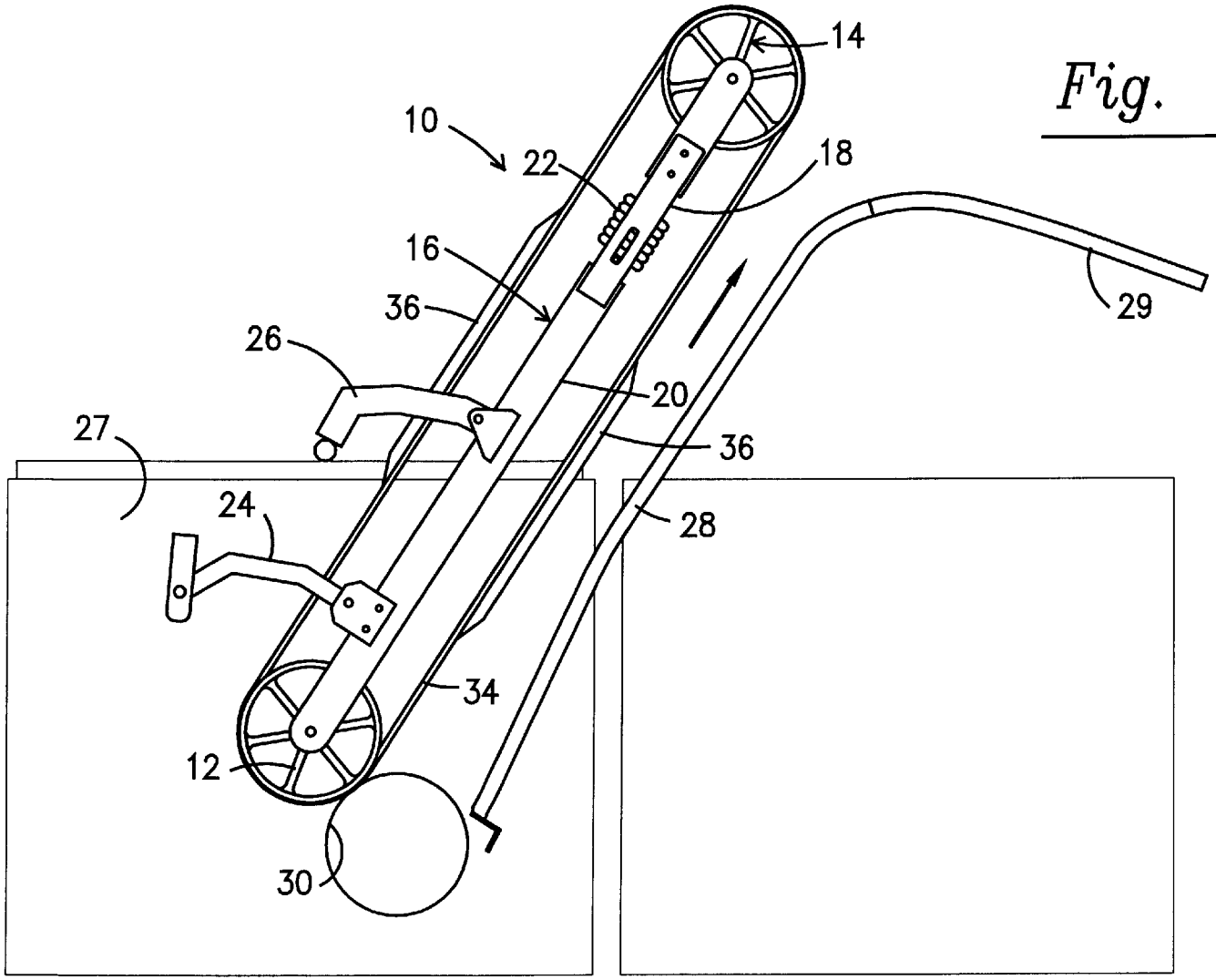
FIG. 1 is a side elevational view of the belt of the present invention along with parts ancillary thereto, prior to the bowling ball being wedged.

Referring to FIG. 1, a ball lift assembly is shown generally at 10 and included a pair of deep grooved pulleys 12 and 14, the lower and upper pulley respectively, rotatably carried by the ends of a tube assembly 16 which includes upper tube 18 inserted into lower tube 20 with a coil compression spring 22 acting between the same in a conventional manner of an AMF ball return. Pivot arms 24 and 26 pivotally connected to the lower tube 20 and a fixed support 27, each of which is spring loaded (not shown) in a direction to urge the tube assembly 16 to the right, as seen in the drawing, toward a fixed lift rail 28, which is convexly curved and is fixedly connected at its upper end to a down sweep 29 which directs the ball to the remainder of the AMF ball return.

Figure 2:
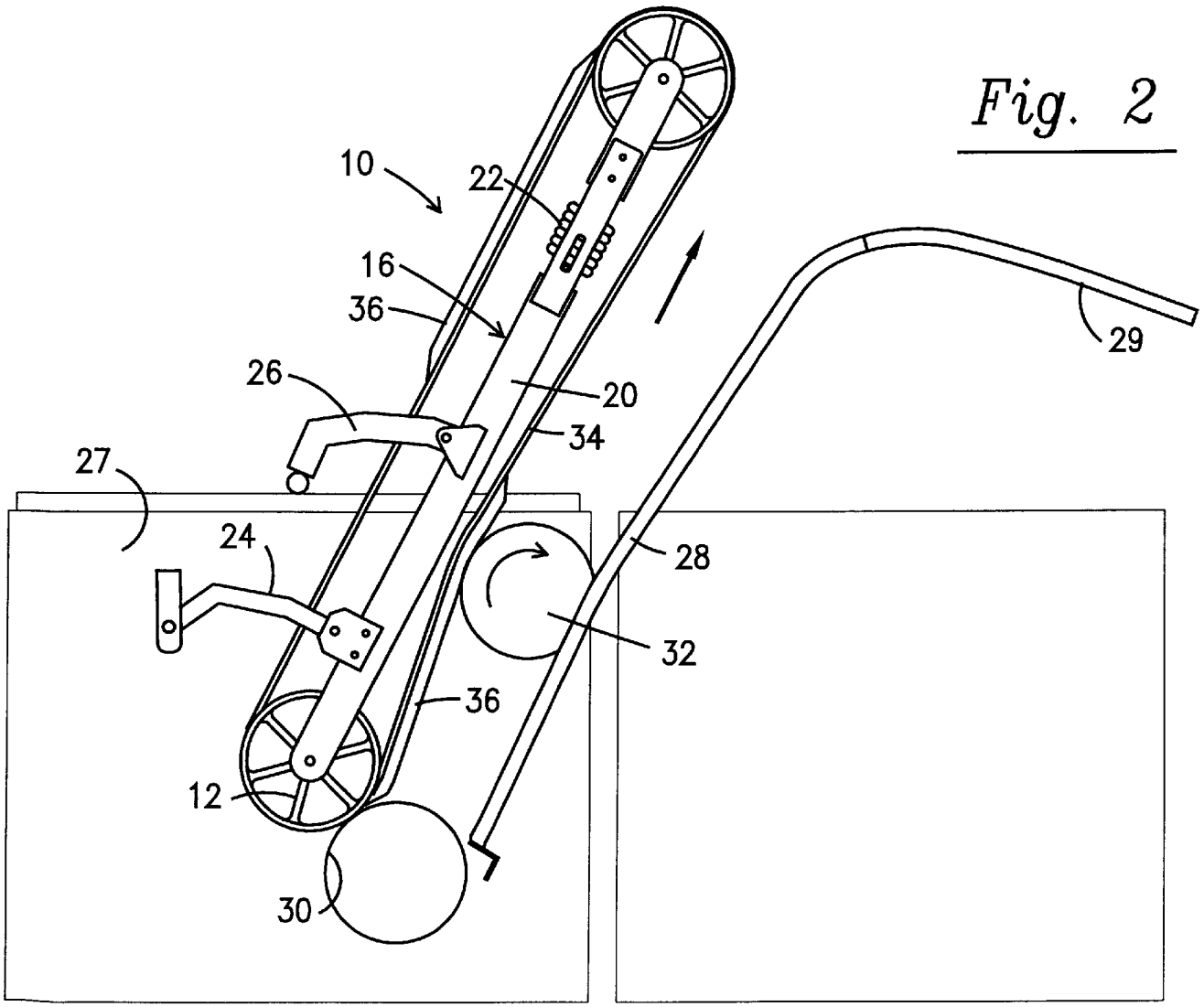
FIG. 2 is a view like FIG. 1 showing a ball wedged between the humped surface and the lift rail.

A ball exit door 30 in the fixed support 27 is shown in FIG. 1, through which a ball passes when leaving the pit area of the bowling alley, exits the pit area to the ball return area, and a ball 32 exiting the door 30 is delivered to the area between the lower end of the lift rail 28 and a hump-backed lift belt 34. The belt 34 has a pair of raised areas or humps 36 thereon, and as seen in FIG. 2, a ball is entrapped between a hump 36 on the belt 34 and the adjoining surface of the lift rail 28. A conventional AMF drive arrangement drives the pulley 12, counterclockwise as shown, so that the belt 34 will roll the ball 32 down the engaging hump 36 and up the lift rail 28, where the ball is delivered to the downsweep 29. The fact that the ball is rolling is important as no skidding takes place to damage the ball or the rail. Since the ball 32 rolls down the hump 36, the hump is preferably at least ½ the length of the lift rail 28 so that the ball will be delivered to the top of the exit rail. However, if more and shorter humps are used so that the ball comes off a hump before delivery at the top of the exit rail, the next hump will then pick up the ball and deliver it to the top of the lift rail.

Figure 4:
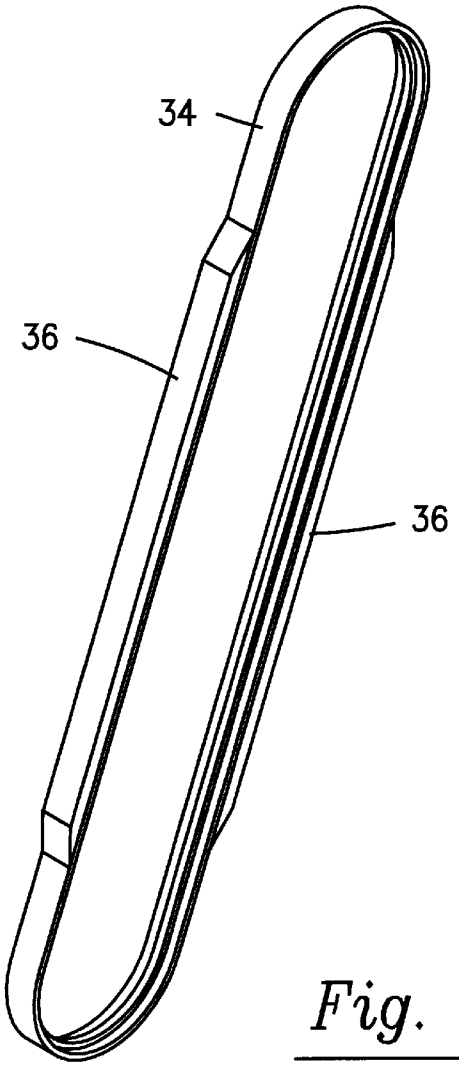
FIG. 4 is a perspective view of a humped belt assembly.
Figure 3:
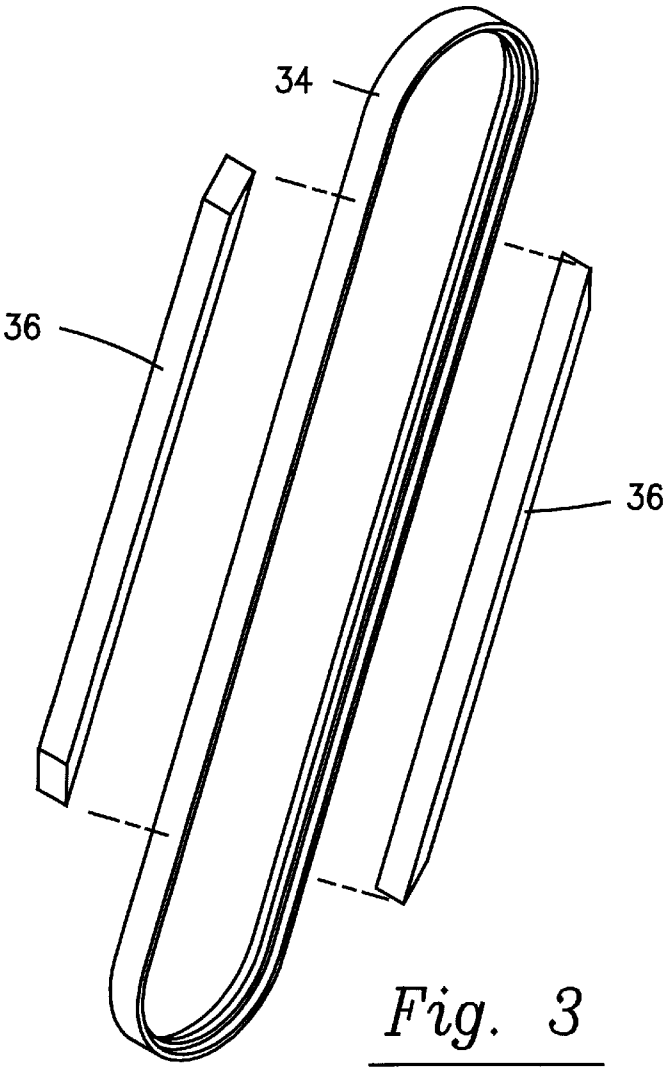
FIG. 3 is a perspective view which shows a hump and belt prior to the assembly thereof.

As seen in FIGS. 3 and 4, the raised sections or humps 36 are preferably twenty-nine inches (29") long and one-half inch (½") high. The forward end of the hump is tapered over an eight inch (8") length from the surface of the belt to its full one-half inch (½") height. The rear end of the hump drops down from its one-half inch (½) height to belt level over a two inch (2") length. Preferably, a formed conventional AMF belt is used (either a used or new belt), and once the hump is secured thereto, a neoprene rubber covering is then bonded around the entire surface of the belt.

Although the above description relates to a presently preferred embodiment, numerous changes can be made therein without departing from the scope of this invention as claimed in the following claims.

What is claimed is:

1. An improvement in an AMF bowling ball return system, having a ball exit door from a pit area to a bottom of a ball return system and including a lift rail leading up from system and a downsweep leading therefrom, and having an upper and lower AMF pulley on which a ball engaging belt is disposed, the improvement comprising that said belt has an outer ball engaging surface thereon and at least one hump means is carried by an outer surface of said belt for wedging a bowling ball between said hump means and said lift rail whereby a wedged bowling ball is rolled up said lift rail and down said hump means to lift a bowling ball to a top of said lift rail.

2. An AMF ball return system according to claim 1 wherein the length of the hump means is at least one-half the length of the lift rail.

3. A return system according to claim 1 wherein the hump means comprises two humps spaced 180 degrees from each other around said belt.

4. A return system according to claim 3 wherein said belt is a conventional AMF belt, said hump means is a separate piece secured to said belt, and a layer of neoprene rubber is bonded about the outer surface of said belt.

* * * * *